US012768078B2

(12) United States Patent
Röder et al.

(10) Patent No.: US 12,768,078 B2
(45) Date of Patent: Oct. 20, 2026

(54) COLD-ALKALI PROCESS FOR THE PRODUCTION OF REGENERATED CELLULOSIC SHAPED BODIES

(71) Applicant: TreeToTextile AB, Stockholm (SE)

(72) Inventors: Thomas Röder, Vöcklabruck (AT); Fritz Suchomel, Schörfling (AT); Sigrid Redlinger, Lenzing (AT)

(73) Assignee: TreeToTextile AB, Stockholm (SE)

( * ) Notice: Subject to any disclaimer, the term of this patent is extended or adjusted under 35 U.S.C. 154(b) by 123 days.

(21) Appl. No.: 18/688,609

(22) PCT Filed: Aug. 31, 2022

(86) PCT No.: PCT/EP2022/074194
§ 371 (c)(1),
(2) Date: Mar. 1, 2024

(87) PCT Pub. No.: WO2023/031270
PCT Pub. Date: Mar. 9, 2023

(65) Prior Publication Data

US 2025/0122645 A1 Apr. 17, 2025

(30) Foreign Application Priority Data

Sep. 3, 2021 (EP) ..... 21194786

(51) Int. Cl.
*D01D 1/02* (2006.01)
*D01D 5/06* (2006.01)
*D01F 2/02* (2006.01)

(52) U.S. Cl.
CPC ..... *D01D 1/02* (2013.01); *D01D 5/06* (2013.01); *D01F 2/02* (2013.01); *D10B 2201/22* (2013.01)

(58) Field of Classification Search
None
See application file for complete search history.

(56) References Cited

U.S. PATENT DOCUMENTS 2,774,441 A * 12/1956 Buurman ..... D01D 1/103 96/194
2,923,604 A 2/1960 Fawley et al.
3,084,021 A 4/1963 Saichi
3,434,913 A 3/1969 Bockno et al.
3,547,837 A * 12/1970 Hirotoshi ..... C08J 9/04 521/88

(Continued)

FOREIGN PATENT DOCUMENTS

BR 9508084 11/1997
BR 9508084 A 11/1997

(Continued)

OTHER PUBLICATIONS

International Search Report and Written Opinion dated Dec. 11, 2022 for Intl. Pat. App. No. PCT/EP2022/074194.

(Continued)

*Primary Examiner* — Emmanuel S Luk
(74) *Attorney, Agent, or Firm* — Husch Blackwell LLP

(57) ABSTRACT

A method for preparing a cooled spinning solution suitable for forming a regenerated cellulosic shaped body by extrusion into a coagulation bath. The method comprises at least one conditioning step during which the spinning solution is distributed over a cooled surface by at least one distributing blade.

20 Claims, 2 Drawing Sheets

(56) References Cited

U.S. PATENT DOCUMENTS

| | | | | |
|---|---|---|---|---|
| 3,720,743 | A | 3/1973 | Dexter et al. | |
| 4,583,984 | A | 4/1986 | Turunen et al. | |
| 5,094,690 | A * | 3/1992 | Zikeli | B01F 21/02 106/190.1 |
| 5,888,288 | A | 3/1999 | Quigley et al. | |
| 2016/0138200 | A1 | 5/2016 | Stigsson et al. | |
| 2018/0119312 | A1* | 5/2018 | Yoshimura | D01D 1/02 |
| 2019/0062950 | A1 | 2/2019 | Hedlund et al. | |
| 2019/0185586 | A1* | 6/2019 | Olsson | C08J 3/05 |
| 2019/0345641 | A1 | 11/2019 | Jung et al. | |
| 2020/0063352 | A1 | 2/2020 | Parker et al. | |
| 2020/0079925 | A1* | 3/2020 | Haslinger | C08J 11/08 |
| 2020/0299416 | A1 | 9/2020 | Stigsson | |
| 2021/0062369 | A1 | 3/2021 | Klaus-Nietrost et al. | |
| 2024/0058511 | A1* | 2/2024 | Kim | D01D 1/106 |

FOREIGN PATENT DOCUMENTS

| | | | |
|---|---|---|---|
| CA | 2193370 | B1 | 6/1995 |
| CA | 3145647 | A1 | 2/2021 |
| CN | 1172487 | A | 2/1998 |
| CN | 103147144 | A | 6/2013 |
| CN | 104220669 | A | 12/2014 |
| CN | 109415844 | A | 3/2019 |
| CN | 110172754 | | 8/2019 |
| CN | 210177024 | U | 3/2020 |
| EP | 0538977 | A1 | 4/1993 |
| EP | 1900860 | A1 | 3/2008 |
| EP | 2692924 | A1 | 2/2014 |
| EP | 3231899 | A1 | 10/2017 |
| EP | 3231901 | | 10/2017 |
| EP | 3443151 | A1 | 2/2019 |
| GB | 1318122 | | 5/1973 |
| PL | 388030 | A1 | 11/2010 |
| PL | 214565 | | 8/2013 |
| PL | 214565 | B1 * | 8/2013 |
| WO | 1995028516 | A1 | 10/1995 |
| WO | 2013122731 | A1 | 8/2013 |
| WO | 2018169479 | | 9/2018 |
| WO | 2020041256 | | 2/2020 |
| WO | 2020126931 | A1 | 6/2020 |
| WO | 2020171767 | | 8/2020 |

OTHER PUBLICATIONS

Machine Translation of PL214565.
International Search Report and Written Opinion mailed Oct. 19, 2022 for Intl. Appl. No. PCT/EP2022/070611.
International Search Report and Written Opinion mailed Nov. 28, 2022 for Intl. Appl. No. PCT/EP2022/070609.
International Search Report and Written Opinion mailed Nov. 9, 2022 for Intl. Appl. No. PCT/EP2022/070612.
Machine Translation of CN110172754.
Chinese Office Action for Application No. 202280065051.5, dated Dec. 18, 2025, 9 pages including translation.
International Search Report and Written Opinion dated Oct. 20, 2022 for International Pat. Appl. No. PCT/ EP2022/070612.
Translation of CN 103147144 A (published on Jun. 12, 2013).
Chinese Office Action for Application No. 2022.80059614.X dated Feb. 2, 2026, 17 pages including translation.
European Communication pursuant to Article 94(3) EPC for Application No. 22754086.1, dated Jun. 29, 2026, 6 pages.

* cited by examiner

COLD-ALKALI PROCESS FOR THE PRODUCTION OF REGENERATED CELLULOSIC SHAPED BODIES

CROSS REFERENCES

This application is a U.S. National Stage Application of International Application No. PCT/EP2022/074194, filed Aug. 31, 2022, which claims priority to European Application No. 21194786.6, filed Sep. 3, 2021, the disclosures of each of which are hereby incorporated by reference herein in their entirety.

TECHNICAL FIELD

The current disclosure relates to the production, use and application of man-made cellulosic shaped bodies such as—but not restricted to—fibers, pellets, powders or films and, more particularly, to processes for the production of regenerated cellulosic shaped bodies which are produced according to a cold-alkali process, the thus produced regenerated cellulosic shaped bodies and their use.

BACKGROUND

Man-made cellulosic shaped bodies are manufactured shaped bodies that are based on cellulosic matter as a source material.

In the context of the current disclosure the term "cellulose" denotes an organic compound derived from plant cell walls or synthetically produced. Cellulose is a polysaccharide and is unbranched. Typically, cellulose comprises several hundred to ten thousand β-D-glucose molecules (β-1, 4-glycosidic bound) or cellobiose units, respectively. The cellulose molecules that are used by plants to produce cellulose fibers are also used in technical processes to produce regenerated cellulose.

The term "regenerated cellulose" denotes a class of materials manufactured by the conversion of natural, synthetical or recycled cellulose to a soluble cellulosic derivative or a directly dissolved cellulose solution and subsequent regeneration, forming shaped bodies, such as fibers (e.g., rayon), films or foils (e.g., cellophane) or bulk solids (e.g. beads, powders or pellets).

The term "cellulosic shaped body," as it is used within the present disclosure, denotes a two- or three-dimensional geometric body that comprises regenerated cellulose. Particularly it denotes two- or three-dimensional objects comprising or consisting of cellulose that are produced by extrusion of a cellulosic spinning dope. Cellulosic shaped bodies can especially comprise a lyocell shaped body, a viscose shaped body, a modal shaped body, a paper shaped body (paper material) or a shaped body produced by another regeneration process, e.g., a cold-alkali process. Examples of typical shaped bodies comprise filaments, fibers, sponges, films, bulk solids.

The term "fibers," as it is used herein, denotes continuous filaments as well as cut staple fibers of any desired length.

The terms "film" or "foil", as used herein denotes a planar shaped body having a defined thickness, which is adjustable in the production process.

Cellulosic shaped bodies can also be in the form of a woven, knitted or non-woven fabric comprising cellulosic filaments and/or cellulosic fibers. Woven fabrics comprise textile planar fabrics made from at least two crossed thread systems, which can be referred to as warp- and weft-yarns. By contrast, the yarn in knitted fabrics follows a meandering path (a course), forming symmetric loops (also called bights) symmetrically above and below the mean path of the yarn.

The term "non-woven fabric" denotes fabrics that are neither woven nor knitted. Non-woven fabrics can be in the form of a fabric comprising randomly oriented fibers and/or cut yarns of finite length. Non-woven fabrics can also comprise endless yarns, e.g., produced by a melt-blown-process.

Cellulosic shaped bodies can further be produced in the form of balls, pellets, beads, granules, flakes, particles, powders, spherical powders, fibrids or the like, which can, for example, be used in further processing steps. Cellulosic shaped bodies can also be porous shaped bodies, such as sponges or foam materials. Cellulosic shaped bodies can preferably be produced by extrusion of a spinning solution comprising cellulose through a number of extrusion nozzles. This allows the production of large quantities of shaped bodies with a very uniform shape. Cellulosic shaped bodies can be used for the production of intermediate or end products, which can be cellulosic shaped bodies themselves. Examples of such intermediate or end products comprise yarns, textiles, gels, papers, cardboards, filter materials, filters, composite materials or the like.

The current disclosure is primarily directed to the production of regenerated cellulosic fibers. Nonetheless, it should be understood that the description can, without undue burden, also be applied to other shaped bodies by the skilled practitioner, unless specifically stated otherwise.

As viscose fibers, regenerated cellulosic fibers are denoted, which are manufactured by means of a wet spinning method which is called viscose-method. The starting raw material of the viscose-method is cellulose which is usually provided on the basis of wood. From this starting raw material, a highly pure cellulose in form of dissolving pulp is obtained. Additionally, or as an alternative other cellulosic materials, such as bamboo based cellulose, cotton linters, recycled cellulosic materials, reed, etc., or mixtures of such materials can be used as a starting raw material. In subsequent process stages, the pulp is first treated with caustic soda (NaOH), whereby alkali cellulose is formed. In a subsequent conversion of said alkali cellulose with carbon disulfide, cellulose-xanthogenate is formed. From this, by further supplying NaOH, the viscose-spinning solution is generated which is pumped through holes of shower-like spinning nozzles into a coagulation bath (also referred to as spin bath). There, one viscose-filament per spinning nozzle hole is generated by coagulation. To coagulate the spinning solution, an acidic coagulation bath is used. The thus generated viscose-filaments are subsequently post processed. The post processing usually comprises several washing- and stretching steps and the filaments are cut to viscose-staple fibers. Several other post-processing steps, such as crimping, bleaching, dying, drying and/or finishing ("soft finish") can be performed on the uncut and/or the cut fibers. In the context of this document, the term "viscose process" denotes such a xanthogenate process.

The term "Lyocell," as used herein, denotes a regenerated fiber type comprising cellulose, which is manufactured according to a direct solvent method. The cellulose for the lyocell-method is extracted from the raw material containing the cellulose. The thus obtained pulp may subsequently be dissolved in a suitable solvent under dehydration without chemical modification. In large-scale industrial implementation N-methylmorpholine-N-oxide (NMMO) is currently used as solvent, nonetheless it is known that other solvents, such as ionic liquids or deep eutectic solvents, can also be used for the process. The spinning dope is then filtered and, for the production of fibers, subsequently extruded through spinning nozzles into an air gap where they are drawn and coagulated by means of a conditioned airstream and then are fed into a coagulation bath containing an aqueous NMMO-solution. Subsequently the fibers can be further processed, e.g., washed, bleached, finished, cross-linked, crimped, cut to staple fibers, etc.

Another well-known process for the manufacturing of regenerated cellulose shaped bodies is the carbamate-method, which is similar to the viscose-process but uses urea instead of carbon disulfide. Still another process, which is called modal-process, is a modified viscose-process for the production of higher quality fibers. For these processes, also an acidic coagulation bath is used.

Further, processes for manufacturing of cellulosic products are known that can use an alkaline spin bath comprising a salt. To prepare the spinning solution, cellulose is dissolved in an aqueous alkaline medium at a controlled temperature. Such processes are herein generally denoted as "cold-alkali process."

WO2018/169479 discloses an example of a fiber produced by a cold-alkali process. The method comprises: providing a spinning dope comprising a solution of cellulose and an additive in an alkaline solvent, in which solvent cellulose is present at a concentration of from about 5 to 12 percent by weight and the additive is present in the range of from 0.1-10 percent by weight calculated on the cellulose; contacting the cellulose spinning dope with an aqueous coagulation bath fluid having a pH value above 7 and comprising a salt; forming a regenerated cellulosic fiber composition; and stretching and washing the fiber composition in one or more washing and stretching baths.

EP3231901A1 discloses a similar process, wherein a spin dope is prepared by dissolving cellulose in an aqueous NaOH solution. The spin bath comprises a coagulation liquid comprising an aqueous sodium salt solution.

EP3231899A1 discloses a method for preparing a spinning dope by direct dissolution of cellulose in cold alkali.

WO2020171767A1 discloses a process for forming a fiber tow involving a wet spinning procedure comprising the steps of: dissolving cellulose pulp in an alkaline aqueous solvent to form a cellulose spin dope composition, spinning the cellulose spin dope composition in a coagulation bath having a pH of more than 7.0, preferably a pH of at least 10, to produce a fiber tow, and passing the produced fiber tow through a sequence of consecutive stretching and washing steps in which the formed fiber tow is washed with a washing liquid by a counter-current flow washing procedure.

Especially shaped bodies, such as fibers, that are produced according to the cold-alkali process issue numerous challenges concerning the setup of the process conditions. Subsequent production steps, such as carding, yarn spinning, textile production or fleece production, require staple fibers having, for example, a sufficiently high tenacity, low brittleness and an appropriate crimp. One important requirement to reach these desired properties of the shaped bodies lies in the production of an appropriate spinning dope. The need for massive cooling of the spinning dope demands new and innovative methods and apparatus that allow for a scale-up to large-scale industry.

SUMMARY

The present disclosure describes methods and apparatuses for the production of regenerated cellulosic shaped bodies.

In a first aspect, the present disclosure relates to a method for preparing a cooled spinning solution suitable for forming a regenerated cellulosic shaped body by extrusion into a coagulation bath. The method comprises at least one conditioning step during which the spinning solution is distributed over a cooled surface by at least one distributing blade. The method can be used for the preparation of spinning solutions that need to be cooled to prevent the spinning solution to be heated above a gelling temperature during mixing and dissolving. The cooled surface therefore has to be cooled below the gelling temperature of the spinning solution. During the mixing of the components, which is usually done in a high-shear mixer, a considerable amount of heat can be input into the spinning solution and the implementation of an adequate cooling for the mixing vessel has proven difficult and energy consuming. Surprisingly, it has been found that by distributing the spinning solution over a cooled surface with a distributing blade allows for the preparation of high-quality spinning solution at a rather low expenditure of energy. The distributing blade can be moved along the cooled surface, preferably in a repetitive manner, leaving a gap between the cooled surface and the distributing blade through which the spinning solution is pressed and distributed by the moving blade.

According to one embodiment, the spinning solution can be prepared by dissolving cellulose in an aqueous solvent comprising NaOH and ZnO, wherein the spinning solution is suitable for being extruded into a coagulation bath having a pH-value of at least seven and containing a salt and preferably an alkali. This allows for a highly efficient preparation of the spinning solution according to the so-called cold-alkali process. The person skilled in the art and having knowledge of the teachings disclosed herein is able to choose a suitable salt for use in the coagulation bath. The salt facilitates a coagulation of the spinning solution and preferably can be present in the coagulation bath in a ratio ranging from 10 percent per weight to 30 percent per weight. Preferably, the salt is a sodium salt, e.g., sodium carbonate or sodium sulfate. Further suitable salts can be chosen by taking into account the Hofmeister series (also known as the lyotropic series), which classifies ions in order of their precipitation capacities. The salt should, for one thing, allow for a quick coagulation and secondly, it should facilitate recovery and recycling of the compounds. Alternative, but less preferred coagulation sodium salts include sodium salts wherein the counter ion is a carboxylate (e.g., formate, acetate, propionate, butyrate or benzoate), an aliphatic or aromatic sulfonate (e.g., benzenesulfonate, toluenesulfonate, or methanesulfonate), an aliphatic or aromatic phosphonate ion or mixtures thereof. Preferably, the anionic counter ion has a dense electric charge, placing it in the beginning of the Hofmeister series. Anionic counter ions having a dense electric charge are characterized as strongly "salting out" proteins, due to their ability to increase surface tension and organize water molecules in solvation shells around them. Further, the coagulation sodium salt is preferably a sodium salt precipitating as a hydrate. Preferably the molar ratio of water to sodium salt in the precipitated hydrate is at least 4:1.

According to another embodiment, the width of a gap between the distributing blade and the cooled surface ranges from about 0.5 mm to about 5 mm, preferably from about 1 mm to about 3 mm. It has been found that within a range from 0.5 to 5 mm a good balance between cooling intensity and mixing/shearing intensity of the spinning solution can be found, wherein in many cases an optimal value can be found in the range from 1 mm to 3 mm. For distributing the spinning solution through the gap preferably the distributing blade is moved along the cooled surface at an adequate relative speed. The optimal speed mostly depends on the viscosity of the spinning solution and the size of the installation. Generally, optimal relative speeds can be found in the range of about 0.1 m/s to about 10 m/s. The optimal speed depends, inter alia, on the size and dimensions of the conditioner and the viscosity of the spinning solution.

According to another embodiment, the cooled surface can be adjusted to a temperature ranging from about −10° C. to about 0° C. and/or the spinning solution can be adjusted to a temperature between about −10° C. and about 0° C. In this range, neither gelling nor freezing of the spinning solution is to be expected and a good cooling effect can be achieved. Due to the heat introduced by the distributing and mixing of the spinning solution, the temperature of the spinning solution will generally adjust to a stable state during the conditioning step. To keep the temperature constant, only the heat energy that is introduced by the mechanical agitation has to be removed by the cooling. It can be advantageous to adjust and maintain this temperature at a preferred value, e.g., by implementing a temperature control system. Adjusting the temperature of the spinning solution to a preferred and stable value improves process stability. Optionally, a plurality of heating zones can be defined in which the temperature can be independently set, adjusted and/or controlled.

According to another embodiment, the surrounding conditions during the conditioning step are adjusted to a reduced pressure, preferably in the range of 50 mbar to 300 mbar. The reduced pressure provides for a deaeration of the spinning solution and facilitates the following filtering of the spinning solution. If applicable, a downstream deaeration can completely be omitted. It should be considered that the reduced pressure can contribute to the cooling through evaporation. Also, the water loss due to evaporation should be considered.

According to a further embodiment, the residence time of the spinning solution in the conditioning step ranges from about 10 min to about 60 minutes. The residence time can, for example, be adjusted by the composition of the spinning solution, its temperature and its viscosity, by the form, size, configuration and drive speeds of the conditioning equipment and/or by the supply of spinning solution.

According to still a further embodiment, the conditioning step is performed in at least one thin film treatment apparatus. This allows for a large-scale industrial application of the method.

In another aspect, the present disclosure relates to a method for producing a regenerated cellulosic shaped body, comprising the extrusion of a spinning dope produced by a method as it is disclosed herein.

In a further aspect, the present disclosure relates to a processing facility for preparing a spinning solution suitable for forming a regenerated cellulosic shaped body by extrusion into a coagulation bath, wherein the processing facility comprises at least one conditioner, wherein the conditioner comprises at least one distributing blade and at least one cooled surface, wherein the spinning solution is distributed over the cooled surface by at least one distributing blade. The processing facility allows for the industrial implementation and scale up of the methods disclosed herein.

According to one embodiment, the processing facility comprises a mixer for blending the components of the spinning solution. Before it is fed into the conditioner, the mixer prepares a suspension/slurry by mixing the components of the spinning solution, preferably cellulose, NaOH and ZnO, and homogenizing them. Further mixing and/or homogenizing can be done in the conditioner.

According to another embodiment, the width of a gap between the distributing blade and the cooled surface lies within a range from about 0.5 mm to about 5 mm, preferably from about 1 mm to about 3 mm.

According to one embodiment, the cooled surface can comprise at least two temperature zones, wherein the temperature within each temperature zone that can be independently set and/or adjusted and/or controlled. The cooled surface can have several, for example two, three or more, separate temperature zones with independent temperature settings which allows for a reliable and stable process control.

According to still another embodiment, at least one temperature zone within the cooled surface can be adjustable to a temperature in a range between about −10° C. and about 0° C. and/or the processing facility can comprises a control unit adapted to adjust the temperature of the spinning solution in the conditioner to a temperature between about −10° C. and about 0° C. The conditioner is configured to reach and maintain a temperature in this range under operating conditions.

According to a further embodiment, the distributing blade can be formed by an edge of a rotating paddle, wherein the surface can be an inner surface of a vessel. With a rotating paddle a simple and effective configuration of a conditioner can be realized. The form of the paddle can additionally contribute to the mixing, homogenization and/or transportation of the spinning solution.

Preferably, according to another embodiment, the facility comprises a plurality of paddles with different configuration. The paddles can, for example, provide for scraper blades or transporting blades. A scraper blade is in contact with the cooling wall and follows the distributing blade to scrape of the spinning solution from the wall after it has been squeezed through the gap. This can improve the homogeneity of the temperature distribution in the spinning solution and the quality of the spinning solution. A transporting blade moves the spinning solution in a flow direction.

According to another embodiment, the vessel can be a thin film treatment apparatus. The term "thin film treatment apparatus," as it is used herein, designates a vessel comprising a usually cylindrical or funnel shaped inner wall and a centered rotating shaft. The vessel can be arranged in a vertical. horizontal or skewed manner. The shaft is usually provided with a plurality of paddles comprising a distributing blade. On rotation of the shaft the distributing blade moves parallel to the inner wall forming a gap between the distributing blade and the inner wall. According to the present disclosure, the inner wall is cooled and provides the cooled surface. The use of a thin film treatment apparatus facilitates the scale-up of the production method to large-industry scale.

According to another embodiment, the interior of the conditioner can be adjustable to a reduced pressure, preferably in the range of 50 mbar to 300 mbar.

According to still another embodiment, the conditioner can be adapted for a residence time of the spinning solution within the conditioner from about 10 min to about 60 minutes.

These and other aspects are merely illustrative of the innumerable aspects associated with the present disclosure and should not be deemed as limiting in any manner. These and other aspects, features, and advantages of the present disclosure will become apparent from the following detailed description when taken in conjunction with the referenced drawings.

BRIEF DESCRIPTION OF THE DRAWINGS

Reference is now made more particularly to the drawings, which illustrate the best presently known mode of carrying out the present disclosure and wherein similar reference characters indicate the same parts throughout the views.

DETAILED DESCRIPTION

The following description of technology is merely exemplary in nature of the subject matter, manufacture, and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

The headings and sub-headings used herein are intended only for general organization of topics within the present disclosure and are not intended to limit the disclosure of the technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Detailed Description" section of this specification are hereby incorporated by reference in their entirety.

Figure 1:
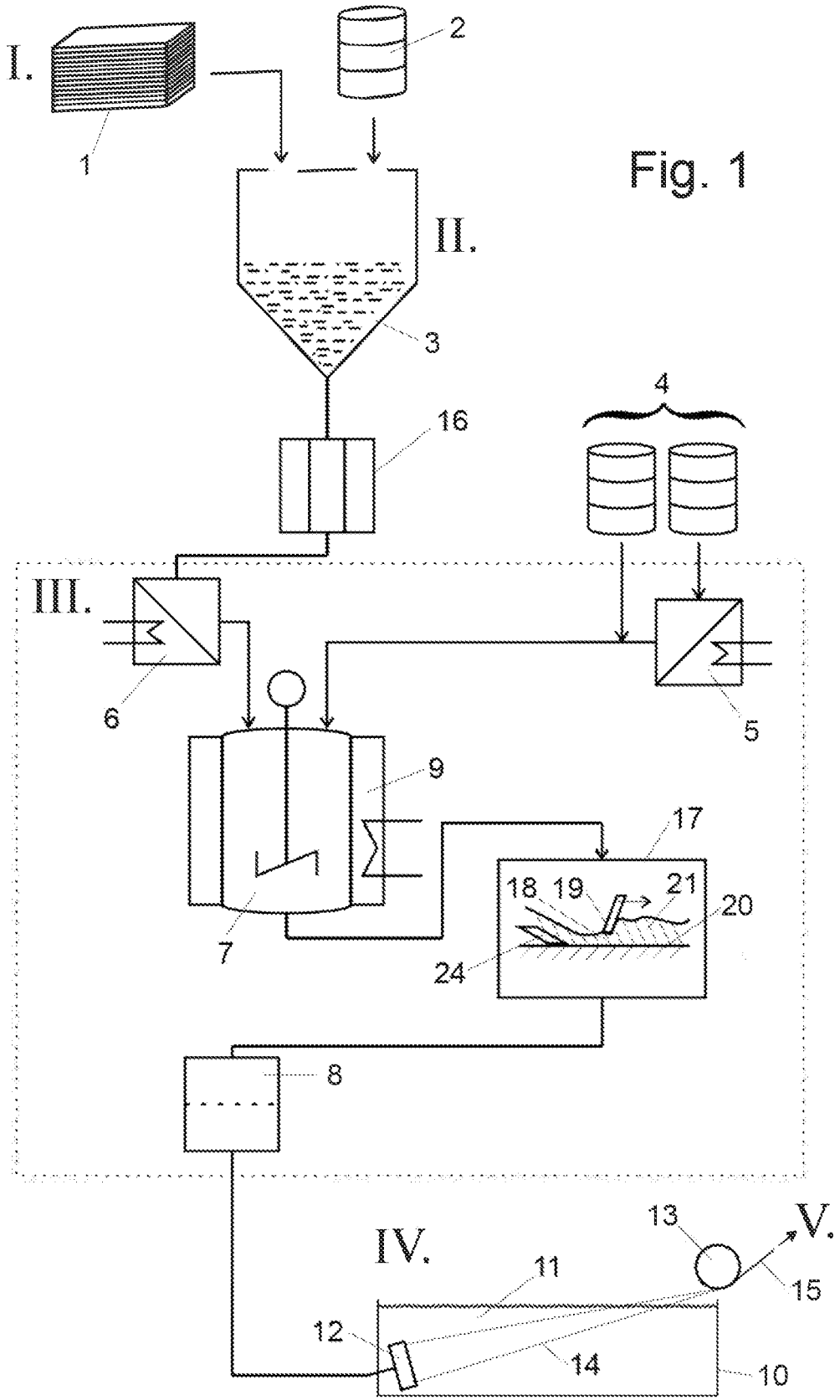
FIG. 1 is a schematic and exemplified representation of a fiber production process according to an embodiment of the present disclosure focusing on the spinning dope preparation.

FIG. 1 shows a flowchart representing an exemplary fiber production process according to the present disclosure. The diagram is a simplified representation and shows the process in a schematized manner.

The process can be sectioned into the following basic steps, which are denoted in with roman numbers in FIG. 1:

Supplying the Raw Material

For the process according to the present disclosure a broad range of possible cellulosic raw materials can be used. Generally, the intrinsic viscosity and the degree of polymerization of the cellulose used as a raw material is lower than it is common for the viscose- or lyocell-process. For example, dissolving pulp (kraft or sulphite) with an intrinsic viscosity (measured in Cuen, according to SCAN-CM 15:99) of about 200 mL/g to 700 mL/g (degree of polymerization DP of 500 to 1900), preferably between about 250 and about 400 mL/g (DP of 600 to 950) can be used. Further, recycling pulp or cotton linters (preferably having the same DP as stated above) can be used. The recycling pulp can, for example, be derived from waste paper, recycled viscose textile material, recycled modal textile material, recycled lyocell textile material and/or recycled cotton fiber textile material. Blends of pulps of different origin, such as blends of virgin wood pulp with recycling pulp, are possible and may be even desirable.

In FIG. 1 a staple of dissolving pulp 1 is exemplarily depicted as the raw material

Pretreatment of the Raw Material

The cellulosic raw material can be subjected to a pretreatment, wherein the degree of polymerization is adjusted to a desired DP to guarantee the dissolution of the pulp and to adjust the viscosity of the spinning dope to a value that allows for filtering and spinning. The pretreatment can comprise subjecting the raw material to an acidic pulp treatment, wherein the DP-value is mainly influenced by the duration of the pretreatment, the process temperature and the concentration of the acid. Also, other pretreatment methods exist, such as alkali treatment, enzymatic pretreatment, irradiation or combinations of such methods. In other cases, the pretreatment can be omitted, if the DP-value is already at the desired value. For example, pulp derived from cellulosic regenerate fibers can have a DP that allows for a direct dissolution without a pretreatment.

In a more specific example, an acidic pulp treatment with 1-10 percent per weight sulfuric acid at 50° C. to 95° C. for a duration from 5 min to 2 h can be used as a pretreatment. As the profitability of the process is reduced by a long duration of this treatment step, it is generally preferable to minimize the duration of the pretreatment as far as possible. The person skilled in the art, who is aware of the teachings of this disclosure is able to find suitable parameters and optimize them without undue burden.

The pretreatment further comprises washing the cellulosic material with water and pressing to reduce moisture content (not shown in FIG. 1), e.g., to about 50 percent per weight of the cellulosic material.

To improve the accessibility and solubility of the cellulose the cellulose can be treated in a refiner 16. In the refiner 16 the cellulose is suspended in water (to a cellulose density of about 2 percent per weight to 12 percent per weight) and defibered. Refining could also be combined with the acidic pretreatment.

In FIG. 1 a source for a pretreatment chemical 2, e.g., sulfuric acid, a pretreatment vessel 3 and a refiner 16 are exemplarily depicted. After the pretreatment in pretreatment vessel 3 the cellulosic material can be squeezed and washed to reduce the amount of acid that is transported to the next steps. Also, after the refiner 16 the cellulose can be squeezed to reduce the water contents to a desired value. Optionally, the cellulosic material can be neutralized prior to entering the refiner or after refining.

Preparation of the Spinning Dope

To prepare the spinning dope (also called spinning solution), the wet and pretreated pulp is first cooled to about 0° C. (while freezing of the pulp should be avoided), and an aqueous solvent comprising NaOH and ZnO is prepared. Preferably the solvent is adjusted to provide a spinning solution comprising 5 to 10 percent per weight NaOH and 0.8 to 3 percent per weight ZnO. The solvent is cooled down to a process temperature, which preferably lies between −5° C. and −10° C. Preferably the solvent is cooled down to a temperature of about −10° C.

The pulp and the solvent are blended in a mixer 7 to dissolve the cellulose in the solvent. To improve the processability, the preparation of the spinning dope comprises a mixing step followed by a homogenization step. During the mixing step the blend is mixed with a high shear stress, which can be done in a high-shear mixer. This high shear stress mixing is preferably only performed for a rather short period of time, for example the mixing can be done for 1-2 minutes. In the following homogenization step the blend is agitated with a lower shear intensity. The homogenization step can last longer than the mixing step, for example about 5 minutes.

During both the mixing and the homogenization step the temperature of the mixture needs to be controlled, especially cooling is required in order to keep the temperature of the mixture within the permitted range. Preferably the temperature is kept below 0° C. The process temperature should never exceed 5° C., as the solution could then thicken and be irrecoverably lost. During the high-shear stress mixing a considerable amount of heat is generated and input into the mixture, which adds to the cooling requirement. This adverse effect is the reason that the high-shear stress mixing can only be done for a rather short period of time.

According to the present disclosure, it is intended to reduce the effort of the mixing and homogenization to a minimum. It is sufficient to only pre-disperse the components of the spinning solution before the following conditioning step, in which the spinning solution can be homogenized and the cellulose can be completely dissolved. According to a preferred embodiment, the step of high-shear stress mixing can even be completely omitted.

After the mixing and homogenization, the spinning solution is transferred to a conditioner 17, which is only schematically shown in FIG. 1. In the conditioner the spinning solution is further dissolved, homogenized and adjusted to a suitable viscosity. The depiction in FIG. 1 shows the basic principle of a conditioner 17 which can be practically implemented in numerous ways, one of which will be described in a more detailed way in connection with the description below of a thin film treatment apparatus shown in FIG. 2.

The conditioner 17 comprises at least one distributing blade 19, which is arranged spaced apart from a cooled surface 20 to form a gap 18 between the cooled surface 20 and the distributing blade 19. A relative movement between the cooled surface 20 and the distributing blade 19 presses the spinning dope 21 that is located on the cooled surface 20 and/or the distributing blade 19 onto the cooled surface and through the gap 19. In practical implementations this squeezing is preferably done by a plurality of distributing blades 19 that can, for example, be actuated in a circular movement along a circular cooled surface. In other embodiments the distributing blades can be actuated in parallel to a flat cooled surface (e.g., the bottom of a vessel), for example in a reciprocating movement or in a circular movement. The distributing blade 19 can be followed by a scraper blade 24 to detach the spinning solution from the cooled surface 20. A scraper blade 24 is not necessary in all configurations but can be advantageous to improve the homogenization of the spinning solution and the temperature distribution therein. Also, additional blades with a different form can be provided, e.g., to impact and adjust the residence time of the spinning solution within the conditioner 17.

In one embodiment the conditioner 17 can be evacuated, for example to a reduced pressure in the range of about 50 mbar to about 300 mbar, so that remaining air in the spinning solution 21 can be removed already during the conditioning step. This can obviate the need for further de-aeration steps before the extrusion of the spinning solution 21.

The so conditioned spinning solution is then filtered in a filter 8 and, if necessary, can further be deaerated. For example, the spinning dope can be filtrated with filters that are essentially the same or similar to the ones that are used in the viscose industry.

Other techniques for filtering and deaerating the dope that can be used are known to the person skilled in the art. According to the present disclosure, a deaeration can be omitted by use of a conditioner which is sufficiently evacuated to a reduced pressure. Generally, many techniques that are known per se from the viscose industry can also be used for the cold-alkali processes.

The prepared spinning dope should be free of voids, have a homogenous consistency and a proper viscosity that allows for a proper fiber formation and a good fiber quality. Additives can also be admixed to the spinning dope to improve fiber properties.

In a preferred embodiment the ballfall-viscosity of the spinning dope should be in the range of about 30 to 200 s. The ballfall-viscosity can be measured according to DIN 53015-2019. The viscosity of the spinning dope can be adjusted by several different means. For example, the viscosity can be adjusted by altering the DP-value of the cellulose, by changing the composition of the solvent and/or the concentration of the cellulose in the spinning dope. For example, the concentration of the cellulose can be in the range of about 4 percent per weight to about 12 percent per weight, particularly in the range of about 5 percent per weight to about 8 percent per weight preferably about 6 percent to about 7 percent per weight.

The specific parameters of the mixing, homogenization, conditioning and filtering steps can be found by the person skilled in the art, who is aware of the current disclosure, by routine work and experimentation.

In FIG. 1 a chemical repository 4 for the storage of the ingredients of the solvent, a solvent cooling device 5 for the cooling of at least parts of the solvent, a pulp cooling device 6, a mixer 7, a conditioner 17 and a filter 8 are exemplarily depicted. The mixer 7 is provided with a cooling jacket 9.

Extrusion Into the Coagulation Bath

The spinning dope can be extruded through a number of nozzle directly into a coagulation bath. In case additives are added to the spinning dope, the dope can be homogenized via a static mixer to incorporate additives. Before the extrusion step, the dope can preferably be tempered to spinning temperature, for example to a temperature in the range of from 5° C. to 30° C.

The coagulation bath comprises an alkali, preferably NaOH, and a salt, preferably sodium carbonate, $Na_2CO_3$, or sodium sulfate, $Na_2SO_4$. As an example, the coagulation bath can comprise from 10 percent per weight to 30 percent per weight $Na_2CO_3$ or $Na_2SO_4$ and from 0 to 7.5 percent per weight NaOH, preferably from 0.1 to 3% and still more preferred from 0.2 to 0.7 percent per weight NaOH. In a specific example the coagulation bath can comprise about 22 percent per weight $Na_2CO_3$ and about 0.5 percent per weight NaOH. The temperature of the coagulation bath can, for example, be adjusted to between 10° C. and 30° C., and preferably be tempered at about 20° C.

The fiber tow is drawn out of the coagulation bath to a transporting section, which can comprise several godets and/or pulleys that transport the fiber tow through a series of post-processing stages. The pull-off force that is exerted on the freshly extruded fibers can be regulated by the extrusion speed and the speed of the first transporting unit (or godet), which preferably can be positioned outside of the coagulation bath. Due to the drawing force, which is exerted on the freshly extruded fibers by the first transporting unit, the fibers get stretched already inside the coagulation bath. Further stretching steps can be during the following post processing of the fibers.

In FIG. 1 a coagulation bath 10 comprising a coagulation liquid 11, a spinneret 12 and a first godet 13 are exemplarily depicted. The spinneret 12 extrudes a number of fibers 14 (corresponding to the number of holes of the spinneret 12) into the coagulation liquid 11. The freshly extruded fibers 14 are gathered together into a fiber tow 15 by the first godet 13. By adjusting the extrusion speed at the spinneret 12 and the speed of the godet 13 the amount of stretching, that is done directly after extrusion within the coagulation bath 10 can be set. Although an inclined angle of the spinneret 12 (and the freshly extruded fibers 14) is shown in FIG. 1, the skilled practitioner, who is aware of the current teaching, is able to apply other spinning configurations that are per se known in the field, e.g., from viscose production.

Post-Processing of the Fiber Tow

As it is used throughout this disclosure, the term "post-processing" encompasses all processing steps that are performed on the extruded fibers after they have been withdrawn from the coagulation bath. Post-processing steps can be applied to the fiber tow while it is transported on the transporting unit. Additionally, the fiber tow can be cut in a cutting apparatus and further post-processing steps can be performed on the cut fibers.

Post-processing of the fibers can comprise, but are not restricted to, any combination of one or more of the following steps:

- washing of the fiber tow and/or the cut fibers,
- pressing the fiber tow and/or the cut fibers to reduce the amount of liquid therein,
- neutralizing the fiber tow and/or the cut fibers with an acidic liquid,
- bleaching the fiber tow and/or the cut fibers,
- crosslinking the fiber tow and/or the cut fibers by applying a crosslinking agent on the fibers,
- applying a finishing agent ("soft finish") to the fibers of the fiber tow and/or the cut fibers,
- drying the fiber tow and/or the cut fibers.

Immediately after the fibers in the fiber tow have been withdrawn from the coagulation bath, they already have been stretched to a certain extent, preferably to about 20-30%, but have not reached their final stretch (and final cellulose specific diameter).

The fibers in the fiber tow can be stretched to their final cellulose specific diameter during post-processing. For example, the fibers in the fiber tow can be stretched to essentially their final cellulose specific diameter (=titer) within a conditioning bath that is arranged after the coagulation bath and having a composition similar to the coagulation bath. In other embodiments, the fibers in the fiber tow can be stretched in several consecutive incremental stretching steps, e.g., in combination with several washing steps.

Figure 2:
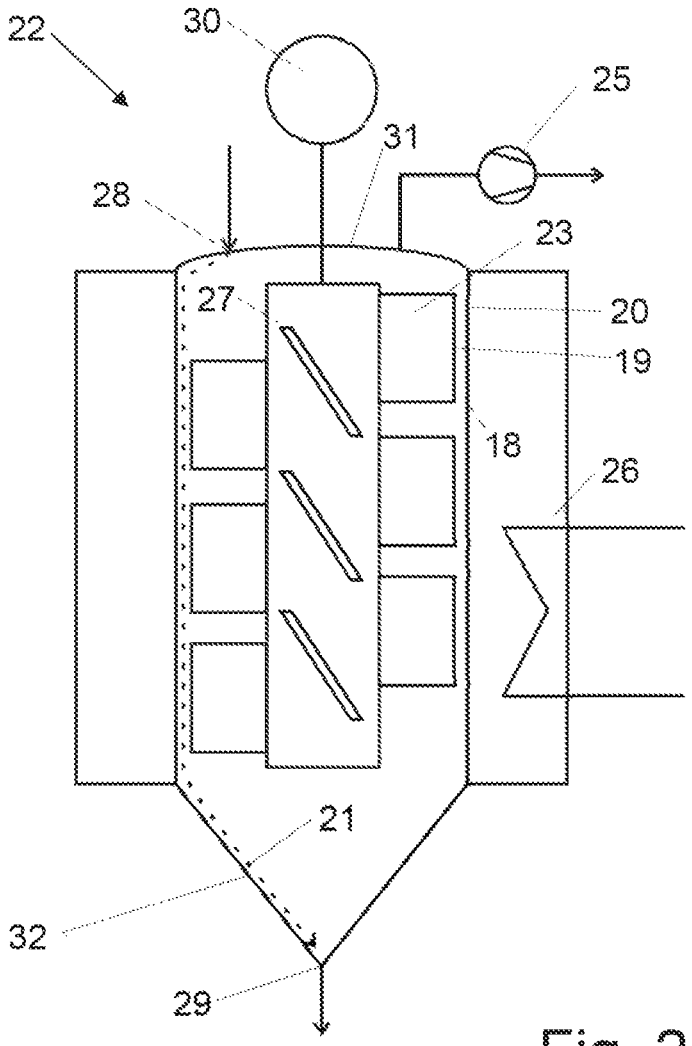
FIG. 2 is a schematic depiction of a thin film treatment apparatus according to an embodiment of the present disclosure.

FIG. 2 shows a schematic illustration of a thin film treatment apparatus 22, which can be used as a conditioner 17. The use of a thin film treatment apparatus 22 allows for a scale-up to large-industry dimensions.

Thin film treatment apparatuses are per se known in the art. Thin film treatment apparatuses are commercially available, for example, under the trademark "Filmtruder" by the Buss AG. Vertically orientated thin film treatment apparatuses have been disclosed in EP0356419B1 or WO2008/154666 A1 (both of which were filed by the same applicant as the current disclosure) in connection with a lyocell spin-dope preparation. For jurisdictions where this is legally possible, the contents of both EP0356419B1 and WO2008/154666 A1 is incorporated herein by reference. The thin film treatment apparatus 22 comprises a vessel 31 having an inlet 28 for the spinning solution at the top and an outlet 29 for the conditioned spinning solution at the bottom. The inlet 28 is preferably designed in a way to properly spread the spinning solution 21 and to avoid splashing of the spinning solution 21. The vessel 31 has a cylindrical section which is surrounded by a cooler 26. The inner wall of the cylindrical section of the vessel 31 provides a cooled surface 20 along which the spinning solution 21 flows downwards towards the outlet. Centered in the cylindrical section of the vessel 31 a shaft 27 is rotatably arranged and connected to a shaft drive 30. On the shaft 27 a plurality of paddles 23 are arranged which protrude from the shaft 27 towards the cooled surface 20. A terminal end of each paddle forms a distributing blade 19 which is parallel to the cooled surface 20 and moves along the cooled surface 20 due to the rotation of the shaft 27. Between the cooled surface 20 and each distributing blade 19 a gap 18 is formed through which the spinning solution 21, which flows along and adheres to the cooled surface 20 is distributed due to the relative movement of the distributing blade 19 and the cooled surface 20.

FIG. 2 shows the thin film treatment apparatus in a simplified and schematized manner only having one type of paddles defining the distributing blades 19. Nonetheless, the apparatus can also comprise paddles having a different form and function, for example paddles with scraper blades that strip the distributed spinning solution 21 from the cooled surface 20 or paddles with transportation blades that are arranged to transport the spinning solution 21 in conveying direction and to affect the residence time of the spinning solution 21 within the thin film treatment apparatus 22. The residence time of the spinning solution 21 can also be influenced by the design and arrangement (number of blades, inclination angle, etc.) of the distributing blades 19. Also, the form of the distributing blades 19 does not necessarily have to be exactly parallel to the cooled surface 20 but can also be provided with special shapes, such as indentations or teeth.

The interior of the vessel can be evacuated to a reduced pressure by a vacuum pump 25 so that the spinning solution 21 can be deaerated during the treatment in the thin film treatment apparatus 22. This can completely avoid the need for a distinct deaeration step. The intensity of the reduced pressure should be adjusted to the parameters of the spinning solution 21. A too harsh vacuum could lead to an excessive evaporation and also the temperature drop due to evaporation has to be taken into account for the configuration of the thin film treatment apparatus 22 and the temperature settings.

Due to the viscosity of the spinning solution 21, it flows down the cooled surface 20 in a slow motion while being steadily agitated and distributed by the distributing blades 19 (and, as the case may be, the other blades) on its way down to the outlet 29. The residence time of the spinning solution in the thin film treatment apparatus 22 can be adjusted by numerous parameters, for example the viscosity of the spinning solution, the dimension of the thin film treatment apparatus 22, the size and form of the gaps 18, the number, form and arrangement (e.g. inclination angle) of the paddles 23, the rotary speed of the shaft 27, the feed-in quantity, the temperature settings, etc.

At the bottom of the thin film treatment apparatus 22 an exit cone 32 is provided in which the spinning solution 21 is collected before it is discharged through the outlet 29. The exit cone 32 also acts as a buffer and can contribute to the homogeneity of the spinning solution 21. Further buffer vessels (not shown in FIG. 2) can be provided if necessary.

The cooler 26 can be implemented in the form of a cooling jacket which uses a cooling agent. In other embodiments the cooler 26 can (additionally or alternatively) use other cooling means, such as Peltier elements or the like. The cooler 26 can provide consistent cooling to the whole cooled surface 20 or it can have two or more separate cooling zones in which the cooling intensity and temperature can be independently set, adjusted and/or controlled. The thin film treatment apparatus 22 can further be provided with sensors, e.g., temperature sensors, flow sensors, fill level sensors, etc. The sensors can allow for a feedback control of the process parameters, such as temperature regulation, flow regulation, speed regulation (e.g., of the shaft drive 30 or the vacuum pump 25), etc. The use of feedback-controls, e.g., for temperature control, can also be advantageous to avoid freezing of the spinning solution 21.

Depending on the size and dimensions of the thin film treatment apparatus 22, the circumferential speed of the distributing blades 19 can preferably be found within a range from about 0.1 m/s to about 10 m/s, preferably from about 3 m/s to about 8 m/s. In a large-scale industrial implementation, the residence time of the spinning solution 21 on the cooled surface 20 between one distributing blade 19 and the next can be in the range from about 0.01 s to 1 s, preferably from about 0.015 s to 0.1 s.

EXAMPLE

A spinning dope according to the cold-alkali process was produced according to the protocols described herein.

For the preparation of fiber samples prehydrolysis kraft pulp (PHK) with an intrinsic viscosity in Cuen of 405 mL/g was used as a raw material. The pulp was pretreated in 10 percent per weight sulfuric acid at 70° C. for a duration of 23 min to get an intrinsic viscosity of 255 mL/g. The pretreated pulp was washed and then suspended in water, the suspension comprising about 2 to 12 percent per weight cellulose. The suspension was defibered in a refiner and the refined cellulose was squeezed to reduce the moisture content and precooled to about 0° C.

An aqueous solvent comprising NaOH and ZnO was prepared according to the required chemical configuration stated below and precooled to −10° C.

A spinning solution was prepared according to the methods disclosed herein by dissolving the pulp in the aqueous solvent, the final spinning solution comprising 6 percent per weight celluloses, 2.3 percent per weight ZnO and 7.5 percent per weight NaOH. The components of the spinning solution were blended for 1 minute and homogenized under cooling for 5 minutes in a high-shear mixer. During mixing the temperature of the mixture was kept in a range between 0° C. and 5° C.

0.8 liter of the so produced slurry/suspension were poured into a household ice cream machine (Philips HR2303, 20-Watt, cooling pack precooled to about −15° C.) and conditioned therein by agitating the spinning solution with the stirrer for 30 minutes. The stirrer comprised two distributing blades, one on the circular side wall and one on the floor of the cooling bowl, and two scraper blades on the respective opposite sides of the distributing blades. Samples of the spinning solution were taken and analyzed at 15 and 30 min to control the progress of the dissolving of the cellulose. After 30 minutes the cellulose in the spinning solution was essentially completely dissolved. The spinning solution was visually examined and had a homogenous consistency and had no clots. The ballfall viscosity according to DIN 53015-2019 was 65 sec.

The experimental setup described above resulted in a spinning solution that, already after a rather short processing time, had a surprisingly high quality which was superior to the quality of comparison samples, that were previously produced by blending and homogenizing in a high-shear mixer. During the preceding production of the comparison samples, it was found that during the high-shear mixing a lot of thermal energy was input into the spinning solution and it was difficult and time-consuming to cool down the spinning solution after each mixing step.

The experiments show that by conditioning the spinning solution according to the present disclosure (i.e., by distributing the spinning solution over a cooled surface with at least one distributing blade) the energy demand for agitation and cooling can be largely reduced. Further, the process can easily be scaled up to large-industry standards by the use of a thin film treatment apparatus that is provided with a cooling device to provide a cooled surface onto which the spinning solution is distributed by the distributing blades of the thin film treatment apparatus.

Further, it is assumed that in an industrial realization a high-shear mixing step (which in the example was used for pre-dispersing the slurry) can completely be omitted by an optimization of properties of the thin film treatment apparatus.

The preferred embodiments of the disclosure have been described above to explain the principles of the present disclosure and its practical application to thereby enable others skilled in the art to utilize the present disclosure. However, as various modifications could be made in the constructions and methods herein described and illustrated without departing from the scope of the present disclosure, it is intended that all matter contained in the foregoing description or shown in the accompanying drawings, including all materials expressly incorporated by reference herein, shall be interpreted as illustrative rather than limiting. Thus, the breadth and scope of the present disclosure should not be limited by the above-described exemplary embodiment but should be defined only in accordance with the following claims appended hereto and their equivalents.

REFERENCE SIGNS dissolving pulp 1
source for a pretreatment chemical 2
pretreatment vessel 3
chemical repository 4
solvent cooling device 5
pulp cooling device 6
mixer 7
de-aerating filter 8
cooling jacket 9
coagulation bath 10
coagulation liquid 11
spinneret 12 first godet 13
fibers 14
fiber tow 15
refiner 16
conditioner 17
gap 18
distributing blade 19
cooled surface 20
spinning solution 21
thin film treatment apparatus 22
paddle 23
scraper blade 24
vacuum pump 25
cooler 26
shaft 27
inlet 28
outlet 29
shaft drive 30
vessel 31
exit cone 32

The invention claimed is:

1. A method for preparing a spinning solution suitable for forming a regenerated cellulosic shaped body by extrusion into a coagulation bath, comprising at least one conditioning step during which the spinning solution is distributed over a cooled surface by at least one distributing blade.

2. The method according to claim 1, further comprising the step of preparing the spinning solution by dissolving cellulose in an aqueous solvent comprising NaOH and ZnO and wherein the spinning solution is suitable for being extruded into the coagulation bath having a pH-value of at least seven and containing a salt.

3. The method according to claim 2, wherein the coagulation bath contains an alkali.

4. The method according to claim 1, wherein a gap between the distributing blade and the cooled surface ranges from about 0.5 mm to about 5 mm wide.

5. The method according to claim 4, wherein the gap between the distributing blade and the cooled surface is between about 1 mm to about 3 mm wide.

6. The method according to claim 1, further comprising at least one of the steps of:

adjusting a temperature of the cooled surface to between about −10° C. and about 0° C., and adjusting the spinning solution to a temperature between about −10° C. and about 0° C.

7. The method according to claim 1, further comprising at least one of the following steps conducted during the at least one conditioning step:

reducing a surrounding pressure, and adjusting a residence time of the spinning solution in the at least one conditioning step between about 10 min and about 60 minutes.

8. The method according to claim 7, wherein the step of reducing a surrounding pressure comprises reducing the pressure to between about 50 mbar to about 300 mbar.

9. The method according to claim 1, wherein the at least one conditioning step is performed in at least one thin film treatment apparatus.

10. A method for producing a regenerated cellulosic shaped body, comprising the step of preparing a spinning solution at least one conditioning step during which the spinning solution is distributed over a cooled surface by at least one distributing blade.

11. A processing facility for preparing a spinning solution suitable for forming a regenerated cellulosic shaped body by extrusion into a coagulation bath, comprising:

at least one conditioner comprising:

at least one distributing blade; and at least one cooled surface; and wherein the spinning solution is distributed over the at least one cooled surface by the at least one distributing blade.

12. The processing facility according to claim 11, wherein the processing facility further comprises a mixer configured to blend components of the spinning solution.

13. The processing facility according to claim 11, further comprising a gap between the at least one distributing blade and the at least one cooled surface, wherein the gap is between about 0.5 mm and about 5 mm.

14. The processing facility according to claim 13, wherein the gap between the at least one distributing blade and the at least one cooled surface is between about 1 mm to about 3 mm.

15. The processing facility according to claim 11, wherein the cooled surface comprises at least two temperature zones, wherein the temperature within each temperature zone that can be independently set and/or adjusted and/or controlled and/or wherein at least one temperature zone within the cooled surface is adjustable to a temperature in a range between about −10° C. and about 0° C. and/or wherein the processing facility comprises a control unit adapted to adjust the temperature of the spinning solution in the conditioner to a temperature between about −10° C. and about 0° C.

16. The processing facility according to claim 11, wherein the at least one distributing blade comprises an edge of a rotating paddle and wherein the at least one cooled surface comprises an inner surface of a vessel and/or wherein the facility comprises a plurality of paddles with different configuration.

17. The processing facility according to claim 16, wherein the vessel is a thin film treatment apparatus.

18. The processing facility according to claim 11, wherein an interior of the at least one conditioner is adjustable to a reduced pressure.

19. The processing facility according to claim 18, wherein the interior of the at least one conditioner is adjustable to a reduced pressure between about 50 mbar to about 300 mbar.

20. The processing facility according to claim 11, wherein the at least one conditioner is adapted for a residence time of the spinning solution within the at least one conditioner between about 10 min to about 60 minutes.

* * * * *